US009469894B2

(12) United States Patent
Van Rijswijk et al.

(10) Patent No.: US 9,469,894 B2
(45) Date of Patent: Oct. 18, 2016

(54) APPARATUS FOR COATING A MOVING STRIP MATERIAL WITH A METALLIC COATING MATERIAL

(75) Inventors: Willem Van Rijswijk, Limmen (NL); Hendrik Bart Van Veldhuizen, Noordwijk (NL); Nicolaas Noort, Heemskerk (NL); Theodorus Franciscus Jozef Maalman, Uitgeest (NL)

(73) Assignee: TATA STEEL NEDERLAND TECHNOLOGY B.V., Ijmuiden (NL)

( * ) Notice: Subject to any disclaimer, the term of this patent is extended or adjusted under 35 U.S.C. 154(b) by 310 days.

(21) Appl. No.: 14/008,544

(22) PCT Filed: Mar. 30, 2012

(86) PCT No.: PCT/EP2012/001400

§ 371 (c)(1),
(2), (4) Date: Oct. 8, 2013

(87) PCT Pub. No.: WO2012/130463

PCT Pub. Date: Oct. 4, 2012

(65) Prior Publication Data

US 2014/0041582 A1 Feb. 13, 2014

(30) Foreign Application Priority Data

Mar. 30, 2011 (EP) ..... 11002611

(51) Int. Cl.
*C23C 2/40* (2006.01)
*C23C 2/00* (2006.01)
(Continued)

(52) U.S. Cl.
CPC ..... *C23C 2/40* (2013.01); *C23C 2/003* (2013.01); *C23C 2/14* (2013.01); *C23C 2/16* (2013.01); *C23C 2/18* (2013.01); *C23C 2/20* (2013.01); *C23C 2/22* (2013.01)

(58) Field of Classification Search
None
See application file for complete search history.

(56) References Cited

U.S. PATENT DOCUMENTS 2,536,186 A * 1/1951 Keller ..... C23C 2/20 118/50
3,251,339 A * 5/1966 Whitfield ..... B05C 3/125 118/122

(Continued)

FOREIGN PATENT DOCUMENTS

BE 1018202 A3 7/2010
FR 2798937 A3 3/2001

(Continued)

OTHER PUBLICATIONS

Prasad, "Laser cutting of metallic coated sheet", Journal of Materials Processing Technology 74 (1998) 234-242.

(Continued)

*Primary Examiner* — Charles Capozzi
(74) *Attorney, Agent, or Firm* — Vorys, Sater, Seymour and Pease LLP

(57) ABSTRACT

An apparatus for coating moving strip material with a metallic coating material, the apparatus including a container for holding metallic coating material, the strip running through the container during use, and including a wiping device for controlling the thickness of the coating on the strip. The container is provided with an opening for the strip leaving the container. The wiping device includes foils or sheets for producing the coating. The walls of the container forming the opening for the strip are directly coupled to the foils or sheets.

30 Claims, 4 Drawing Sheets

(51) Int. Cl.

| | |
|---|---|
| ***C23C 2/14*** | (2006.01) |
| ***C23C 2/16*** | (2006.01) |
| ***C23C 2/18*** | (2006.01) |
| ***C23C 2/20*** | (2006.01) |
| ***C23C 2/22*** | (2006.01) |

(56) References Cited

U.S. PATENT DOCUMENTS

| | | | | | |
|---|---|---|---|---|---|
| 3,383,189 | A | * | 5/1968 | Sendzimir | C23C 2/06 118/402 |
| 3,962,501 | A | | 6/1976 | Ohbu et al. | |
| 4,024,309 | A | | 5/1977 | Pender | |
| 4,078,103 | A | | 3/1978 | Thornton et al. | |
| 4,082,864 | A | | 4/1978 | Kendall et al. | |
| 4,128,676 | A | | 12/1978 | Lee | |
| 4,888,052 | A | | 12/1989 | Harris et al. | |
| 5,472,740 | A | * | 12/1995 | Kubota | C23C 2/38 427/319 |
| 5,702,528 | A | * | 12/1997 | Paramonov | C23C 2/38 118/404 |
| 5,954,879 | A | * | 9/1999 | Lison | D06B 3/18 118/405 |
| 5,965,210 | A | | 10/1999 | Tada et al. | |
| 6,174,570 | B1 | | 1/2001 | Dambrine et al. | |
| 2012/0064254 | A1 | | 3/2012 | Franchet et al. | |
| 2014/0023797 | A1 | | 1/2014 | Van Rijswljk et al. | |

FOREIGN PATENT DOCUMENTS

| | | | |
|---|---|---|---|
| FR | 2945823 | A1 | 11/2010 |
| JP | 58009964 | A | 1/1983 |
| WO | 2010001330 | A2 | 1/2010 |
| WO | 2012130464 | A1 | 10/2012 |

OTHER PUBLICATIONS

May 30, 2014, Office Action for U.S. Appl. No. 14/008,545, Rijswijk et al. filed Oct. 8, 2013.

Oct. 8, 2014, Office Action for U.S. Appl. No. 14/008,545, Rijswijk et al. filed Oct. 8, 2013.

International Search Report dated May 4, 2012 from International Application PCT/EP2012/001400 to Tata Steel Nederland Technology B.V. filed Mar. 30, 2012.

* cited by examiner

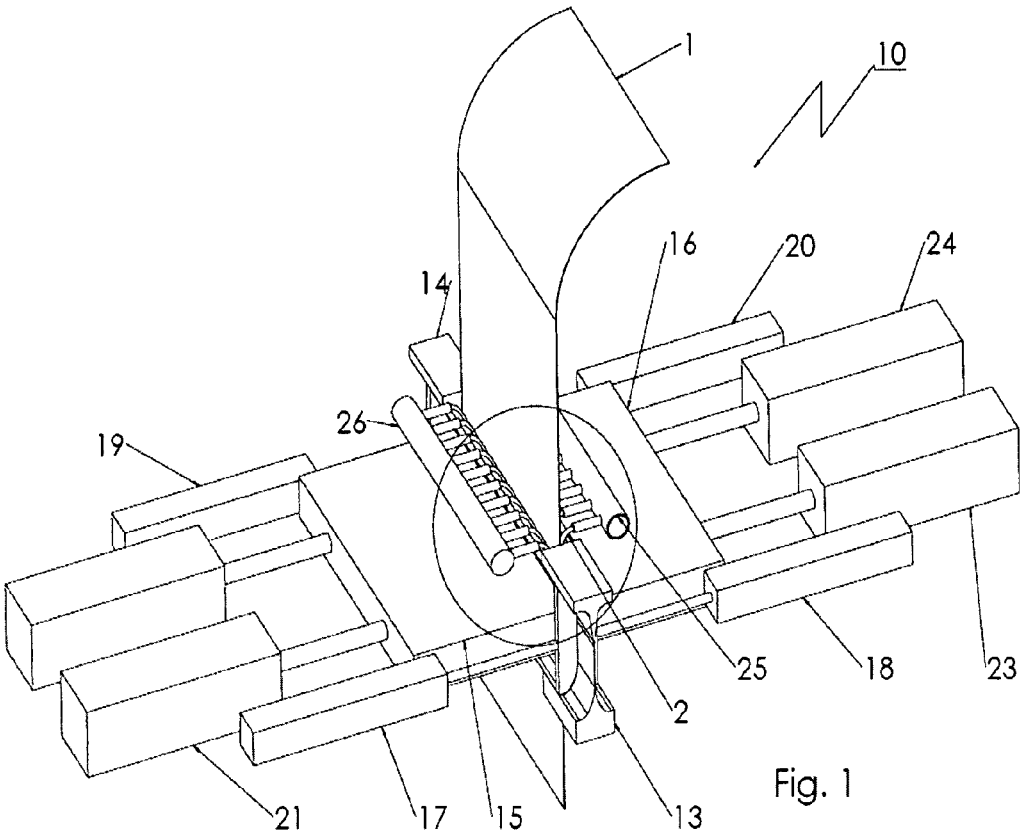
Fig. 1
Fig. 2
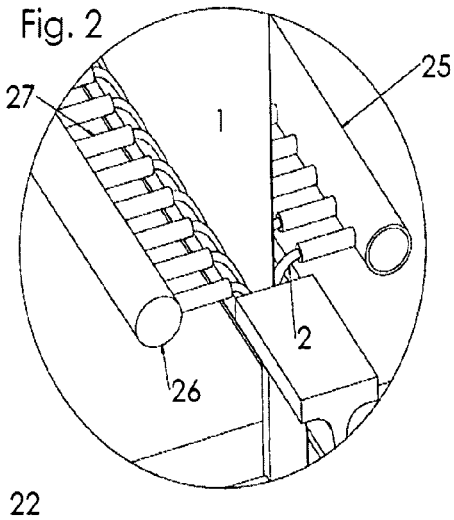

APPARATUS FOR COATING A MOVING STRIP MATERIAL WITH A METALLIC COATING MATERIAL

CROSS-REFERENCE TO RELATED APPLICATIONS

This is a §371 US National Stage Application of International Application No. PCT/EP2012/001400 filed on 30 Mar. 2012, claiming the priority of European Patent Application No. 11002611.9 filed on 30 Mar. 2011.

The invention relates to an apparatus for coating moving strip material with a metallic coating material, the apparatus comprising a container for holding metallic coating material, the strip running through the container during use, and comprising a wiping device for controlling the thickness of the coating on the strip.

Such an apparatus is well known in the art and is called a hot dip coating apparatus for coating a steel strip with for instance aluminum or aluminum alloys or zinc or zinc alloys. For coating with zinc, usually the apparatus consists of a container with a zinc bath, through which the steel strip is guided using a submerged guiding roll. Normally the strip is forwarded from an annealing line and enters the zinc bath through a snout under an angle at an elevated temperature. After rounding the guiding roll, the steel strip leaves the zinc bath in a vertical direction, on both sides coated with a zinc layer. For commercial use this zinc coating is too thick, and a wiping device is present not far above the zinc bath to wipe off the surplus of zinc. Usually air knives are used to wipe the zinc from the steel sheet. Since the steel strip can be up to 2 meters in width, the zinc baths often have a volume of about 24 cubic meters.

Recently a novel type of wiping device has been developed, as described in Belgian patent application 1018202. This wiping device mainly consists of two foils or sheets which are pressed towards the steel strip using a number of springs. This wiping device is placed above the zinc bath as described hereinabove in the place of the usual air knives. When the zinc coated steel strip moves through a gap between the foils of the wiping device, the foils are more or less planing, floating or gliding on the liquid zinc on the steel strip, similar to the well-known aquaplaning effect. By adjusting the pressure exerted by the springs, the thickness of the zinc coating leaving the wiping device can be controlled. In this way coatings with a reduced thickness as compared to coatings formed using air knives can be produced.

However, it has been found that the foil wiping device of BE 1018202 can not be used in practice because zinc dross particles that are formed in and on the zinc bath are entrained with the zinc that forms the coating on the steel strip. Zinc dross particles contain iron and aluminum and are quite hard. The zinc dross particles get stuck between the foil of the wiping device and the steel strip and cause scratches on the steel strip. For this reason, the wiping device of BE 1018202 is not used in practice.

It is an object of the invention to provide an apparatus for coating moving strip material with a metallic coating material which can coat strip material with a higher velocity of the strip.

It is another object of the invention to provide an apparatus for coating moving strip material with a metallic coating material which can produce zinc or zinc alloy coatings on steel strip which are reduced in thickness as compared to the existing commercial apparatus.

It is a further object of the invention to provide an apparatus for coating moving strip material with a metallic coating material that is improved as compared to existing commercial hot dip coating apparatus.

It is a still further object of the invention to provide an apparatus for coating moving strip material with a metallic coating material that is easier to use than existing commercial hot dip coating apparatus.

It is also an object of the invention to provide an apparatus for coating moving strip material with a metallic coating material that is less costly in use than existing commercial hot dip coating apparatus.

According to the invention, one or more of these objects are reached with an apparatus for coating moving strip material with a metallic coating material, the apparatus comprising a container for holding metallic coating material, the strip running through the container during use, and comprising a wiping device for controlling the thickness of the coating on the strip, wherein the container is provided with an opening for the strip leaving the container, wherein the wiping device comprises foils or sheets for producing the coating, and wherein the walls of the container forming the opening for the strip are directly coupled to the foils or sheets.

Since the walls of the container are directly coupled to the wiping device, the container can be relatively small as compared to the usual container for hot dip coating because the guiding roll can be left out. When zinc or zinc alloy is used as a coating on a steel strip, the container should contain such a small amount of molten zinc that the zinc dross particles remain small and cannot be entrapped between the steel strip and a foil or sheet of the wiping device. In this way, the known foil wiper as discussed above can be used, which provides the possibility to use a high strip velocity and to produce thin coatings of good surface quality.

A relatively small container has also the advantage that the coating system using the apparatus according to the invention is much more flexible than the known hot dip coating line, that it is not necessary to keep a large volume of for instance zinc or aluminum at a high temperature anymore, and that there are no zinc losses due to the forming of zinc dross on the surface of the zinc bath.

According to a preferred embodiment the strip material is a metal strip material, preferably steel strip material. The foil wiping device has been designed for metallic strip material, such as steel strip.

Preferably, the metallic coating material is molten zinc or zinc alloy or aluminum or aluminum alloy. Such molten metallic coating material has to be used at a temperature of a few hundred degrees Celsius, and the apparatus according to the invention is highly suitable to use for metallic coatings because the usual air knives can be left out.

According to a preferred embodiment the container for holding metallic coating material has a volume that is at most 10.000 times the volume V of the coating on the strip per second during use, volume V in $m^3$ being given by the formula $V=2\times d\times w\times s$, wherein d=the thickness of the coating in meters w=the width of the strip in meters s=the velocity of the strip in meters per second.

Using such a volume of the container, dross particles that grow in the molten metallic coating material in the container can remain small enough not to stick between the strip and the foils or sheets of the wiping device. The volume of the container to be used will at least depend on the coating material, the growing rate of the dross particles, the coating thickness on the strip and the velocity of the strip. For this reason, the volume of the container is dependant on these last parameters. In this way, the known foil wiper as discussed above can be used, which provides the possibility of a high strip velocity and thin coatings.

Preferably, the container for holding metallic coating material has a volume that is at most 2000 times the volume V of the coating on the strip per second, more preferably a volume that is at most 500 times the volume of the coating on the strip per second, even more preferably a volume that is at most 100 times the volume of the coating on the strip per second. The smaller the volume of the container, the easier it is to keep the oxidic or metallic dross particles at a size such that they do not stick between the strip and the foils or sheets of the wiping device. A smaller container also has the advantage that a change of coating material on the strip can be executed faster.

According to a preferred embodiment the wiping device is positioned above the container. In this way the strip material will enter the container from below and will leave the apparatus at the upper side of the foil wiping apparatus. This is advantageous because in case of emergency the foil wiping device can be opened and the container can be emptied without contaminating the steel strip that has been coated. The strip material can enter the container vertically, but it is also possible that the strip material enters the container under an angle.

Preferably a reservoir for the metallic coating material is connected with the container so as to fill the container during use of the apparatus. In this way it is easy to keep the bath of metallic coating material in the container at a practically constant volume.

More preferably, the reservoir is connected with the container in such a way, that all the metallic coating material in the container is constantly replenished during use of the apparatus. Thus, the bath of metallic coating material is constantly refreshed and there are no corners of the container where the metallic coating material remains for a longer time than in the remainder of the container.

It is preferred that the reservoir is connected with the container in such a way that the metallic coating material is evenly distributed over the length of the container during use of the apparatus. In this way the replenishing of the metallic coating material is assured.

Preferably, the container has a volume of 1 to 100 liters, more preferably a volume of 2 to 25 liters. Such a volume ensures that all the metallic coating material that is present in the container at a certain moment is used to coat the strip material very shortly thereafter.

According to a preferred embodiment the strip material is steel strip material and the metallic coating material is molten zinc or zinc alloy, and the container is dimensioned such that metallic dross particles formed in the container with molten metallic coating material during use on average are smaller than the thickness of the coating formed on the steel strip. This dimensioning of the container will depend on the speed of the strip, the speed of the growth of the dross particles and the coating thickness, i.e. the average time for removal of the amount of liquid equivalent to one container volume by the moving strip must be smaller than the average growth time of dross particles to a size larger than the coating thickness. Since the distance between the foils or sheets of the foil wiping device and the steel strip is about twice the thickness of the coating on the steel strip, the average metallic dross particles can easily pass between the foils or sheets of the foil wiping device and the steel strip, and also the metallic dross particles that are larger than the average particles will not become entrapped between the foils or sheets of the foil wiping device and the steel strip.

Preferably means are present to retain the metallic coating material in the container, preferably electromagnetic induction means. Such retaining mains are especially needed when the container is positioned below the foil wiping device, and the electromagnetic induction means can exert a force on the metallic coating material that is higher than gravity. Such electromagnetic induction means are known in the art.

Since oxygen often deteriorates the metallic coating material, preferably means are present to keep the metallic coating material in the container out of contact from oxygen in the surrounding air. This is especially important for metallic coating material such as zinc or aluminum or an alloy thereof.

According to a preferred embodiment the foils or sheets of the wiping device are made from a material that is able to withstand the metallic coating material and the forces exerted on it during use, preferably stainless steel or carbon. The foils or sheets should be thin and flexible on the one hand, and strong and resistant on the other hand. Stainless steel and carbon are suitable for these purposes.

Preferably the foils or sheets of the wiping device are coated on the inside with a coating improving the wear and/or corrosion resistance of the foil and on the outside with a protecting coating. Such coatings are known in the art.

According to a preferred embodiment the foils or sheets of the wiping device are extended to form walls of the container. In this way, the container and the foil wiping device form one and the same object, that does not need connecting means between the material of the foils or sheets and the material of the container.

Preferably pressing means are present to press the foils or sheets towards the strip during use, more preferably the pressing means being springs. Since especially for metallic coatings the thickness of the coating can change for different purposes, the pressing means should be controllable. For metallic coatings the forces than must be exerted are quite high, so springs are suitable. Hydraulic pressing means are also possible.

According to a preferred embodiment baffles are present at the sides of the strip during use, to fill the gaps between the strip and the foils or sheets of the wiping device. Such baffles are especially needed for aluminum or steel strip, which usually has a thickness of around 1 mm. The baffles should be controlled such that a change in the width of the strip can be followed.

Preferably the container is directly connected to an annealing device when the strip material is steel strip material, preferably the annealing device comprising heating means to be able to heat the steel strip material before it enters the metallic coating material in the container, and more preferably cooling means are present after the wiping device to be able to cool the steel strip material. Steel strip usually leaves an annealing device and is thereafter as soon as possible coated with a layer of zinc or aluminum. Thus, it is preferred that the container is connected to the annealing device. For third generation high strength steel types, it is preferred when the steel strip can be heated before entering the container and can be cooled after leaving the foil wiping device.

The invention will be elucidated referring to the accompanying drawings.

FIG. 1 shows a schematic representation of the apparatus according to the invention.

FIG. 2 shows a close-up of FIG. 1.

Figure 3:
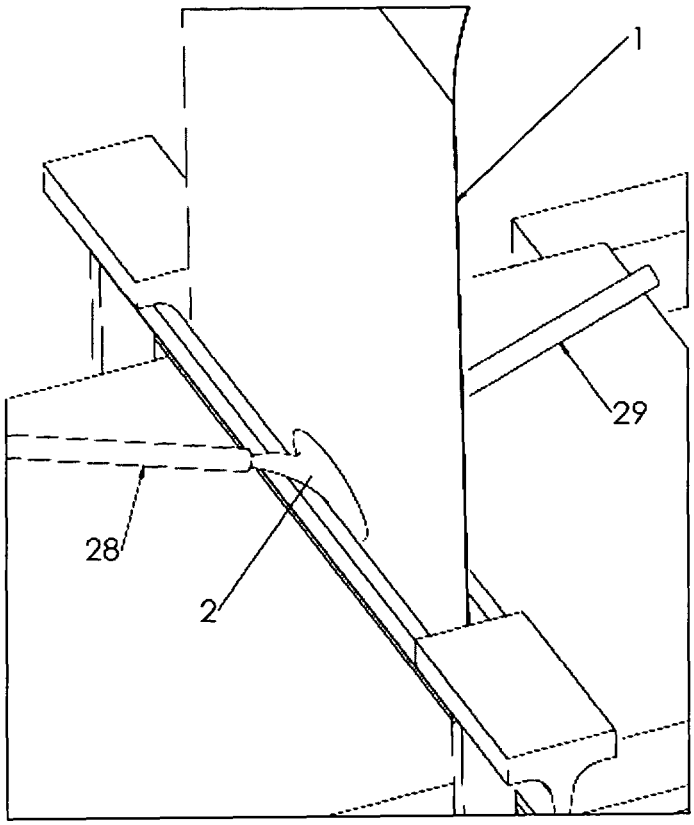
FIG. 3 shows a close-up of FIG. 1 with different means to feed the container.

FIG. 1 shows a steel strip 1 entering the apparatus 10 according to the invention from above. The apparatus essentially consists of two foils 11, 12 (shown in FIG. 5). At the edges of the steel strip 1 baffle means 13, 14 are present to close off the edges of the steel strip and the foils. The foils are pressed against the steel strip using pressing means 15, 16. The baffle means are kept in place using positioning means 17, 18, 19, 20. A container for metallic coating material, such as molten zinc, is formed by the foils 11, 12 and the baffle means 13, 14. The pressing means 15, 16 are empowered by means 21, 22, 23, 24 such as hydraulic cylinders.

Metallic coating material 2 such as molten zinc is supplied from a reservoir (not shown) through tubes 25, 26 which drain the metallic coating material into the container through a number of pipes 27.

This is especially shown in FIG. 2. Here it shows that along the width of the strip 1 and at each side of the strip a number of pipes 27 is attached to the tubes 25, 26 through which the container is filled. The metallic coating material 2 is evenly distributed over the length of the container. This is especially important when zinc or zinc alloy is used as coating material, because dross particles in the zinc should not remain long in the container.

FIG. 3 shows the apparatus according to the invention as shown in FIG. 1, but according to the embodiment of FIG. 3 the container is filled using only one pipe 28, 29 on each side of the strip 1. In this way the coating material is not evenly distributed when entering the container, but this embodiment can be used when no dross particles will be formed in the metallic coating material in the container.

Figure 4:
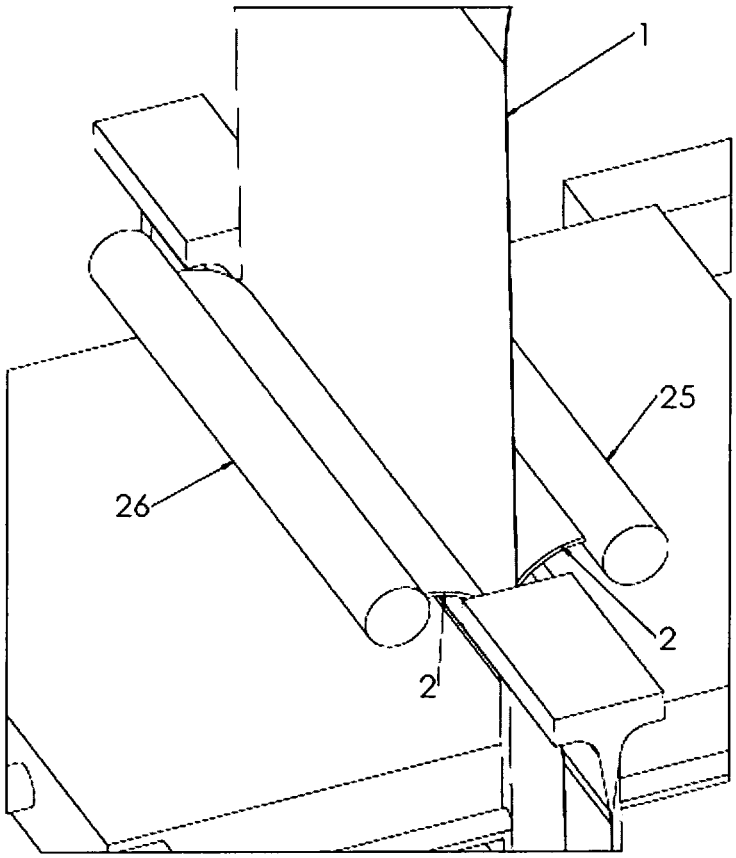
FIG. 4 shows the same as in FIG. 3 with different means to feed the container.

FIG. 4 shows another embodiment of the apparatus according to the invention, using the tubes 25, 26 according to FIG. 1, but without pipes. Here the tubes each have a slit through which the metallic coating material 2 fills the container.

Figure 5:
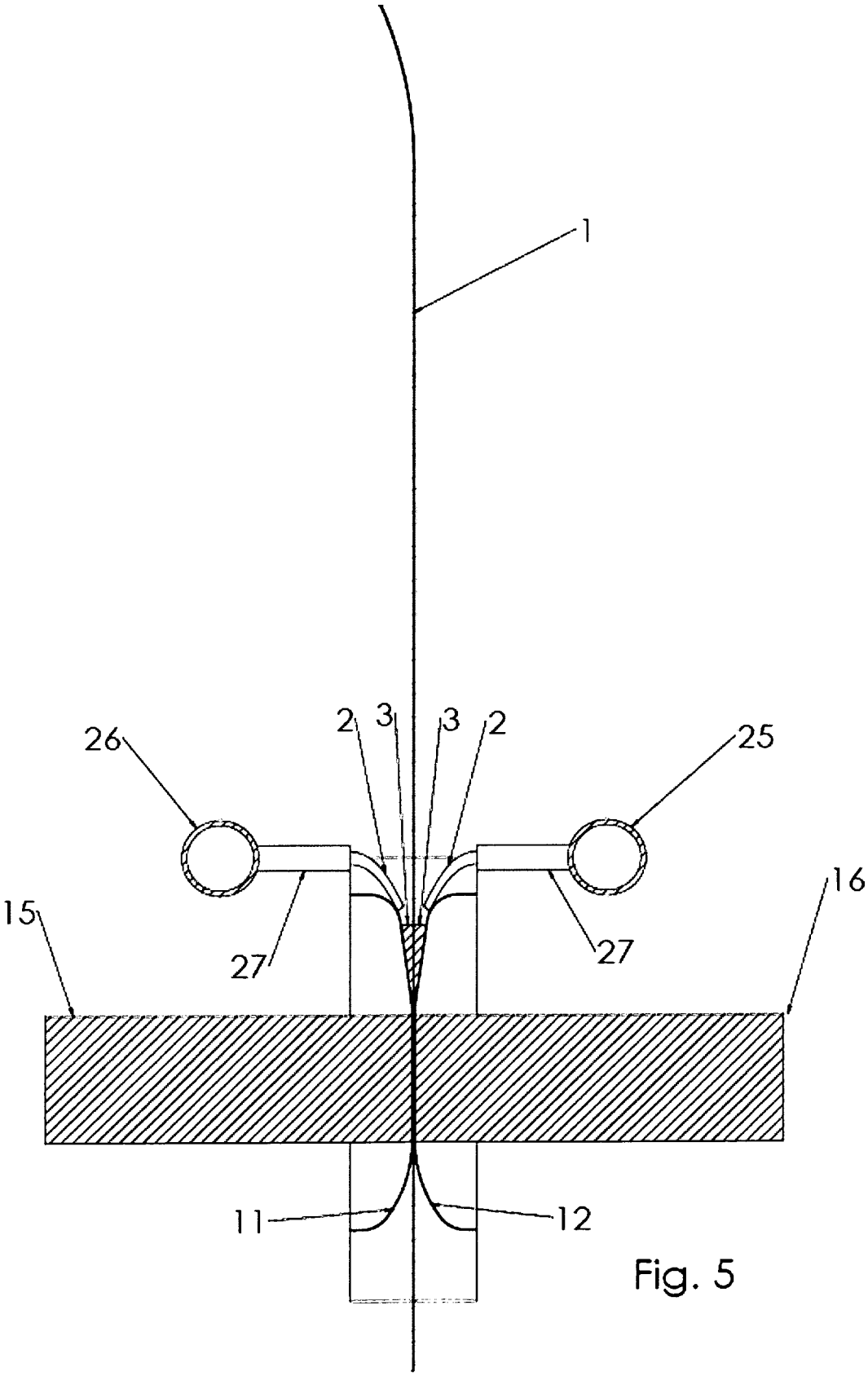
FIG. 5 shows a cross section through the apparatus according to FIG. 1.

FIG. 5 shows a cross section through the apparatus 10 according to FIG. 1. The steel strip 1 runs vertically in between the foils 11, 12 that are pressed against the steel strip 1 by the pressing means 15, 16. The baffle means, the positioning means and the pressing means are not shown in FIG. 5. Shown are two tubes 25, 26 that are connected to one or more reservoirs that are not shown, which reservoirs contain metallic coating material such as molten zinc. The metallic coating material 2 passes through the tubes 25, 26 and fills the zinc bath 3 in the container between the foils 11, 12 supplied from the pipes 27. The steel strip 1 runs through the zinc bath 3 and the foils are pressed against the steel strip to form the zinc coating on the steel strip leaving the foils at the lower side of the apparatus.

Instead of filling the container as shown in FIGS. 1 and 5, it is also possible to fill the container through the foils, under the surface of the bath.

It will be clear that the drawings only give a very schematic representation of the embodiments of the apparatus according to the invention. The skilled person will know how to vary the apparatus based on the description above and the claims below.

The invention claimed is:

1. Apparatus for coating moving strip material with a metallic coating material, the apparatus comprising a container for holding metallic coating material, the strip running through the container during use, and comprising a wiping device for controlling the thickness of the coating on the strip, wherein the container is provided with an opening for the strip leaving the container, wherein the wiping device comprises one pair of opposed foils or sheets for producing the coating, wherein the opposed foils or sheets comprise respective opposed surfaces which define an elongated strip passageway, for running the strip through the wiping device during use, the elongated strip passageway extending between the opening for the strip leaving the container and a strip outlet for the strip leaving the wiping device, a first pair of opposed portions of the one pair of opposed foils or sheets surfaces defining a strip inlet for the strip entering the wiping device, a second pair of opposed portions of the one pair of opposed foils or sheets surfaces defining the strip outlet for the strip leaving the wiping device, the strip inlet and strip outlet being spaced apart and located at opposite ends of the elongated strip passageway and defined by the one pair of the opposed foils or sheets, wherein the opening for the strip leaving the container is in communication with the strip inlet for the strip entering the wiping device for the strip to run from the container into the elongated strip passageway of the wiping device during use, and pressing means comprising pressing surfaces engaging outer surfaces of the opposed foils or sheets and pressing inwardly at least an elongated portion of the opposed foils or sheets towards the strip located between the opposed foils or sheets during use along at least a portion of the elongated strip passageway between the opening for the strip leaving the container and the strip outlet for the strip leaving the wiping device, wherein walls of the container forming the opening for the strip leaving the container are directly coupled to the first pair of portions of the foils or sheets defining the strip inlet of the elongated strip passageway of the wiping device.

2. Apparatus according to claim 1, wherein the strip material is a metal strip material.

3. Apparatus according to claim 1, wherein the metallic coating material is molten zinc or zinc alloy or aluminum or aluminum alloy.

4. Apparatus according to claim 1, wherein the container for holding metallic coating material has a volume that is at most 10,000 times the volume V of the coating on the strip per second during use, volume V in m3 being given by the formula $V=2\times d\times w\times s$, wherein d =the thickness of the coating in meters w =the width of the strip in meters s =the velocity of the strip in meters per second.

5. Apparatus according to claim 4, wherein the container for holding metallic coating material has a volume at most 2000 times the volume V of the coating on the strip per second.

6. Apparatus according to claim 1, wherein the wiping device is positioned above the container.

7. Apparatus according to claim 1, wherein a reservoir for the metallic coating material is connected with the container so as to fill the container during use of the apparatus.

8. Apparatus according to claim 1, wherein the container has a volume of 1 to 100 liters.

9. Apparatus according to claim 1, wherein the strip material is steel strip material and the metallic coating material is molten zinc or zinc alloy, and wherein the container has a volume of 1 to 100 liters for limiting metallic dross particles formed in the container with molten metallic coating material during use on average to be smaller than the thickness of the coating formed on the steel strip.

10. Apparatus according to claim 1, wherein retaining means are present to retain the metallic coating material in the container.

11. Apparatus according to claim 1, wherein the foils or sheets of the wiping device extend, beyond the opening for the strip leaving the container, to form the walls of the container.

12. Apparatus according to claim 1, wherein the foils or sheets of the wiping device are made from a material able to withstand the metallic coating material and the forces exerted on it during use.

13. Apparatus according to claim 1, wherein the foils or sheets of the wiping device are coated on the inside with a coating improving the wear and/or corrosion resistance of the foil and/or on the outside with a protecting coating.

14. Apparatus according to claim 1, wherein the foils or sheets of the wiping device are extended to form the walls of the container.

15. Apparatus according to claim 1, wherein baffles are present at the sides of the strip during use, to fill the gaps between the strip and the foils or sheets of the wiping device.

16. Apparatus according to claim 1, wherein the container is directly connected to an annealing device when the strip material is steel strip material.

17. Apparatus according to claim 2, wherein the strip material is a steel strip material.

18. Apparatus according to claim 1, wherein the container for holding metallic coating material has a volume at most 500 times the volume V of the coating on the strip per second.

19. Apparatus according to claim 1, wherein the container for holding metallic coating material has a volume at most 100 times the volume V of the coating on the strip per second.

20. Apparatus according to claim 7, wherein the reservoir is connected with the container in such a way, that all the metallic coating material in the container is constantly replenished during use of the apparatus.

21. Apparatus according to claim 7, wherein the reservoir is connected with the container in such a way that the metallic coating material is evenly distributed over the length of the container during use of the apparatus.

22. Apparatus according to claim 1, wherein the container has a volume of 2 to 25 liters.

23. Apparatus according to claim 1, wherein electromagnetic induction means are present to retain the metallic coating material in the container.

24. Apparatus according to claim 1, wherein the foils or sheets of the wiping device are made from a stainless steel or carbon material for withstanding the metallic coating material and the forces exerted on it during use.

25. Apparatus according to claim 1, wherein springs are present to press the foils or sheets towards the strip during use.

26. Apparatus according to claim 1, wherein the container is directly connected to an annealing device when the strip material is steel strip material, the annealing device comprising heating means to be able to heat the steel strip material before it enters the metallic coating material in the container.

27. Apparatus according to claim 1, wherein the container is directly connected to an annealing device when the strip material is steel strip material, and cooling means are present after the wiping device to be able to cool the steel strip material.

28. Apparatus according to claim 6, wherein electromagnetic induction means are present to retain the metallic coating material in the container.

29. Apparatus according to claim 1, wherein the foils or sheets have openings therethrough for feeding the metallic coating material to the container under the surface of a bath of the metallic coating material within the container.

30. Apparatus according to claim 1, wherein each foil or sheet has a first portion comprising a first end and extending above the pressing means and a second portion comprising a second end and extending below the pressing means, wherein each first end is above the pressing means and each second end is below the pressing means, wherein at least one flared section selected from the group consisting of (a) opposed said first portions of the opposed foils or sheets and (b) opposed said second portions of the opposed foils or sheets extend and flare outwardly, wherein one said flared section forms the walls of the container.

* * * * *